US005117640A

United States Patent [19]

Ginfrida, Jr.

[11] Patent Number: 5,117,640

[45] Date of Patent: Jun. 2, 1992

[54] SYSTEM FOR VENTING CRYOGEN FROM A CRYOSTAT

[75] Inventor: Clifford J. Ginfrida, Jr., Florence, S.C.

[73] Assignee: General Electric Company, Milwaukee, Wis.

[21] Appl. No.: 677,950

[22] Filed: Apr. 1, 1991

[51] Int. Cl.[5] ..... F17C 7/04

[52] U.S. Cl. ..... 62/48.1; 62/125; 220/745; 220/749; 285/904

[58] Field of Search ..... 62/45.1, 48.1, 125; 220/745, 749; 285/904; 116/216

[56] References Cited

U.S. PATENT DOCUMENTS

| | | | |
|---|---|---|---|
| 3,181,589 | 5/1965 | Phelps | 62/48.1 |
| 3,199,303 | 8/1965 | Haumann et al. | 62/48.1 |
| 3,298,187 | 1/1967 | Short | 92/48.1 |
| 3,548,856 | 12/1970 | Vant | 62/48.1 |
| 3,874,323 | 4/1975 | Rottig | 62/125 |
| 3,884,511 | 5/1975 | Germanson | 285/904 |
| 3,916,641 | 11/1975 | Mullins | 62/125 |
| 4,046,407 | 9/1977 | Porreco | 285/904 |
| 4,350,017 | 9/1982 | Kneip et al. | 62/48.1 |
| 4,367,743 | 1/1983 | Gregory | 62/48.1 |

*Primary Examiner*—Ronald C. Capossela

*Attorney, Agent, or Firm*—James O. Skarsten; Douglas E. Stoner

[57] ABSTRACT

A system is provided for controllably venting cryogen of extremely low temperature from a cryostat, wherein a conduit formed of selected metal provides a path of flow for the cryogen from the cryostat to an exhaust system. A gauge is coupled to the conduit, along the path of flow, by means of a bushing which thermally isolates the gauge from the metallic conduit, which is at an extremely low temperature. Thus, the gauge, which is used to continually monitor cryogen pressure, does not become unreadable due to icing or frosting as a result of heat loss from the gauge to the conduit. The bushing is formed from a material such as GC-10, and includes an intermediate portion for spacing the bushing away from the metallic conduit, and also for enclosing a dead space which substantially reduces heat transfer directly between the gauge and cryogen in the conduit.

7 Claims, 2 Drawing Sheets

SYSTEM FOR VENTING CRYOGEN FROM A CRYOSTAT

BACKGROUND OF THE INVENTION

The invention disclosed and claimed herein pertains to a system for controllably venting cryogen of extremely low temperature from a cryostat, wherein the system includes a gauge for monitoring cryogen pressure. More particularly, the invention pertains to a system of such type which employs simple and inexpensive means to prevent the gauge from becoming unreadable due to the icing or frosting over thereof.

In a superconducting magnet of the type commonly used in magnetic resonance imaging or spectroscopy, magnetic coils are contained in a cryostat and immersed in a liquid cryogen, such as liquid helium. The liquid helium is at a temperature on the order of 4° Kelvin, and the extremely cold environment provided thereby maintains the conductors of the magnetic coils in a superconducting state.

A "quench" occurs when a substantial amount of the liquid cryogen in the cryostat goes into a gaseous state. Quenches are generally unintentional, and result in a sudden rise in cryogen pressure. The pressure must be rapidly relieved, and a flow path must be provided for the gaseous cryogen, to safely direct it to an exhaust or ventilator system so that it can be removed from the vicinity of the cryostat. In a common arrangement, a main cryogen vent line is coupled between the cryostat and the exhaust system, and is sealed by a burst disk. In the event of a quench, the pressure in the vent line immediately exceeds a disk bursting level, such as 20 psi, whereupon the disk is rupured and the gaseous cryogen is enabled to flow through the main vent line to the exhaust system.

When servicing operations are performed, such as to add additional cryogen to the cryostat (referred to as "filling"), or to couple electric current to the magnetic coils (referred to as "ramping"), some heat will be introduced into the interior of the cryostat. The amount of heat will not be enough to cause a quench, but will generate a small amount of gaseous cryogen. This small amount of cryogen must likewise be provided with a flow path from the cryostat to the ventilator or exhaust system. In some arrangements, the flow path is provided by coupling both ends of a disk bypass vent line to the main vent line, one end being coupled on either side of the burst disk. The small amount of gaseous cryogen generated by the servicing activity is thus routed around the burst disk, which is intended to seal the main vent line except for when a quench occurs. Typically, a valve is placed in the bypass vent line, to be opened during servicing activities of the above type, and otherwise to be kept closed.

It will be readily apparent that if the pressure of the cryogen generated during servicing activity exceeds the disk bursting level, the disk will break, even though a quench has not occurred. This is very undesirable, since all the cryogen in the cryostat would thereby be vented and be lost. The bursting disk could also pose a safety hazard to a service operator or other personnel who happened to be in the area at the time. Accordingly, a pressure gauge is placed in the disk bypass line, and is continually monitored by an operator as he performs his servicing tasks. The gauge will show that the pressure in the vent line is rising toward the disk bursting level, so that corrective action can be taken before the bursting level is reached.

The disk bypass vent line, as well as the fitting used to couple the pressure gauge into the bypass line, are typically made of a metal such as brass. While the cryogen flowing through the bypass line is in a gaseous state, it is still extremely cold, such as on the order of 20° Kelvin. Accordingly, the fitting and bypass line become extremely cold, and heat is rapidly conducted away from the pressure gauge. The loss of heat causes the pressure gauge to frost or ice over. In some instances, frost collecting on the pressure gauge causes the gauge to resemble a "snow ball." The gauge thereby becomes unreadable, and is therefore unuseable for providing a warning of hazardous build-up in vent-line pressure.

In the past, a heat gun has been employed to keep the face of the pressure gauge clear from frost. However, such solution requires a service operator to perform an additional activity, and heat from the heat gun can cause distortion of certain of the mechanical parts of the gauge.

SUMMARY OF THE INVENTION

The present invention provides a system for controllably venting cryogen of extremely low temperature from a cryostat, and includes a metallic conduit means for providing a path of flow for the cryogen from the cryostat to an exhaust system. The cryogen venting system further includes a gauge for indicating cryogen pressure in the conduit means, and a bushing or fitting means for coupling the gauge to the conduit means. The fitting means is formed from a material of high thermal impedance and has a first end joined to the gauge, a second end joined to the conduit means, and an intermediate portion between the first and second ends for spatially separating the gauge from the conduit means. The intermediate portion encloses an elongated dead space which substantially reduces heat transfer directly between the gauge and the cryogen in the conduit means.

Preferably, the conduit means is configured to turn the path of cryogen flowing therethrough through an angle on the order of 90°. The gauge and the fitting means are joined to the conduit means, proximate to the 90° turn in the path of cryogen flow.

An object of the invention is to improve efficiency and safety in servicing a cryostat, such as a cryostat containing a superconducting magnet.

Another object is to provide an inexpensive and simple approach to prevent icing of a pressure gauge connected into the external plumbing of a cryostat of the above type.

These and other objects and advantages will become more apparent from the following description, taken in conjunction with the accompanying drawings.

DETAILED DESCRIPTION OF THE PREFERRED EMBODIMENT

Figure 1:
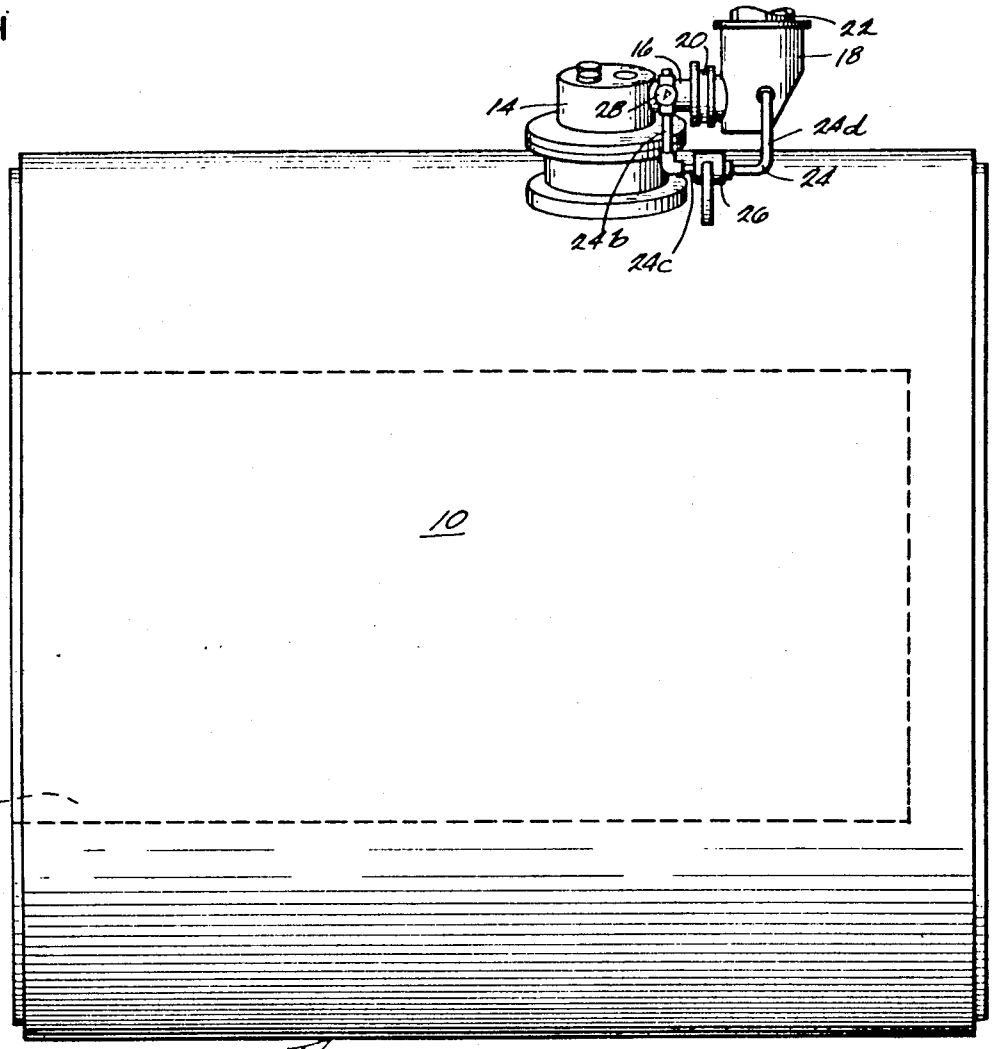
FIG. 1 is a perspective view showing a generalized cryostat and its associated service turret and external plumbing for venting cryogen.

FIG. 1 shows a cryostate 10 of a type used as a component for a magnetic resonance (MR) imaging system. Magnetic coils (not shown) are positioned around a bore 12 formed in the cryostat 10, and are kept immersed in a cryogen such as liquid helium. The coils are thus maintained at a temperature of 4° Kelvin or less, and are therefore in a superconducting state. A current introduced into the superconducting coils will continuously circulate, to generate a magnetic field in the bore 12, which serves as the main magnetic field for MR imaging. FIG. 1 further shows cryostate 10 provided with a service turret 14 which contains ports and electrical connectors (not shown) for adding cryogen to the cryostat and for ramping the coils.

FIG. 1 also shows a three-inch main vent line 16 having one end connected to internal cryogen vent plumbing (not shown) in turret 14 and the other end connected to a vent adapter 18. A burst disk 20 is positioned to tightly seal the main vent line 16. The disk will be ruptured by a pressure in the main vent line on the cryostat side of the disk, which exceeds 20 psi. Thus, if a quench occurs in cryostat 10, the resulting sudden increase in pressure will break the disk 20, thereby allowing the helium gas generated by the quench to be vented through the line 16 to adapter 18.

Vent adapter 18 comprises the lower portion of a cryogen ventilator or exhaust system. A pipe 22 (only a portion of which is shown) is mated to the upper flange of adapter 18 and connects with a ventilator such as a rooftop ventilator (not shown). Such exhaust systems are well known in the art, and thus not described in further detail.

FIG. 1 further shows a disk bypass vent line 24 having one end coupled to main vent line 16, between turret 14 and burst disk 20, and the other end coupled to the adapter 18. A valve 26 is coupled into bypass line 24, valve 26 normally being kept in a closed position, but being opened to allow gaseous helium to flow through bypass line 24 when servicing is being performed on the cryostat 10. Thus, small amounts of gaseous helium generated as a result of ramping, filling or other servicing operations flow through bypass line 24, and therethrough to vent adapter 18. A pressure gauge 28 of conventional design is coupled into bypass line 24 to enable a service operator to detect a rise in cryogen pressure in line 18, resulting from servicing activity. If such a rise was detected, corrective action could be taken to prevent disk 20 from rupturing.

Figure 2:
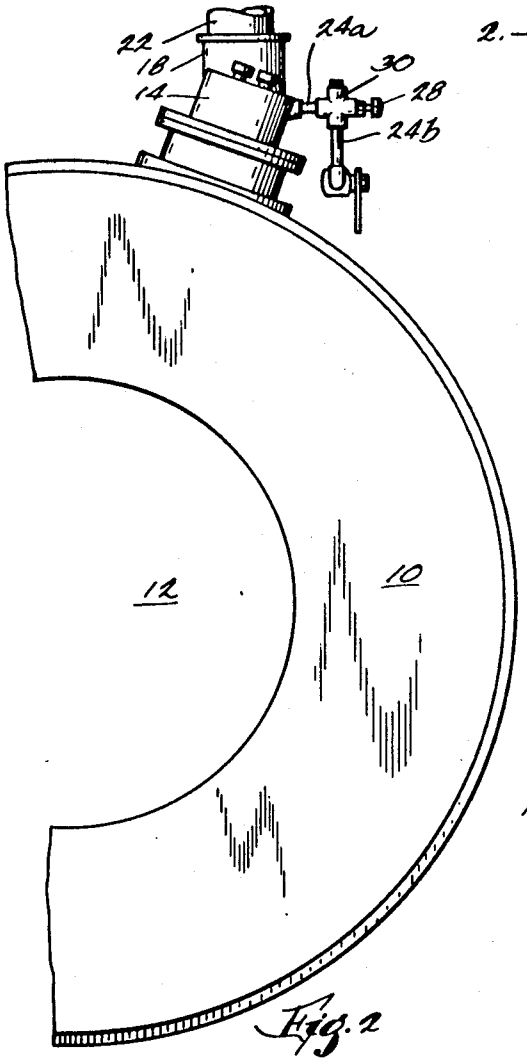
FIG. 2 is an end view taken along lines 2—2 of FIG. 1, a portion of such end view being broken away.

FIGS. 1 and 2 together show bypass line 24 comprising pipe segments 24*a–d*, joined together by conventional fittings. The respective segments and fittings are formed of a metallic material such as brass.

Figure 3:
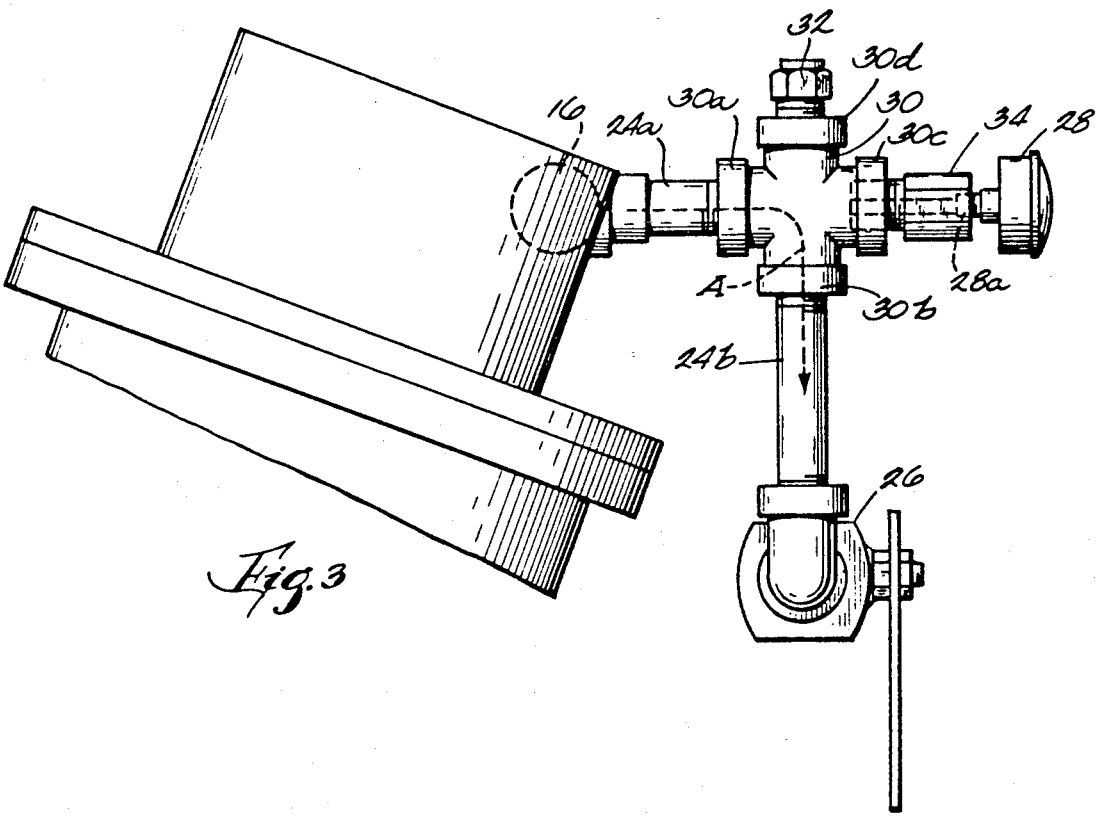
FIG. 3 is a perspective view showing the service turret and external plumbing shown in FIG. 2 in greater detail, to more clearly illustrate an embodiment of the invention.

FIGS. 2 and 3 show bypass line 24 including a conventional fitting 30 referred to as a "plumber's cross." Cross 30 has four ports or openings 30*a–d*, each provided with inside threads. Ports 30*a* and 30*b* are oriented with respect to each other so that pipe segments 24*a* and 24*b*, respectively coupled to ports 30*a* and 30*b*, are oriented at 90° to each other. Accordingly, cryogen flowing through the plumber's cross 30 transits a path which makes a 90° turn, as shown by Arrow A of FIG. 3. Port 30*c* is in opposing relationship with port 30*a*, and port 30*d* is generally kept sealed by means of a plug 32. Plumber's cross 30 is likewise formed of a metallic material such as brass.

FIG. 3 further shows gauge 28 having a threaded end member 28*a* engaging a bushing 34, which has a set of external threads mating with the inner threads of port 30*c*. Thus, bushing 34 is used to couple gauge 28 into bypass line 24, at a point where the path of cryogen flow turns through 90°. By positioning the gauge at a turn in the cryogen path of flow, as shown in FIG. 3, conduction of heat away from the gauge, directly by the cryogen flowing through line 24, is minimized. However, as stated above, the respective components of line 24, including cross 30, typically are formed of brass or other metal. Accordingly, line 24 becomes extremely cold within a short period of time after cryogen starts flowing through it from the cryostat 10. Accordingly, gauge 28 must be thermally isolated from line 24 to substantially reduce or eliminate heat flow from gauge 28 into the cold metallic bypass line.

Such thermal isolation is achieved, in part, by forming bushing 34 of a material such as GC-10, a plastic material which is known in the industry to have a very high thermal impedance. Alternatively, bushing 34 could be formed of a thermo-plastic material known as Xenoy, a trademark of the General Electric Company. To further thermally isolate gauge 28, and to therefore prevent the icing of the gauge, bushing 34 is formed as shown in FIG. 4.

Figure 4:
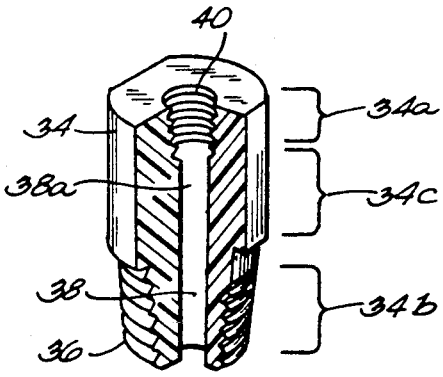
FIG. 4 is a perspective view with a portion broken away of a high thermal impedance bushing employed in the embodiment of FIG. 3.

FIG. 4 shows bushing 34 provided with opposing end portions 34*a* and 34*b*, and an intermediate portion 34*c* between the two end portions. Outer threads 36 are formed around end portion 34*b*, threads 36 mating with the threads of port 30*c* of plumber's fitting 30. Also, a throughhole 38 is formed through bushing 34, inner threads 40 being formed in a portion of the throughhole which traverses end portion 34*a*. Threads 40 match the threads of end member 28*a* of pressure gauge 28. Thus, bushing 34 serves to join gauge 28 to plumber's cross 30, and at the same time, spaces the gauge 28 away from cross 30, which, as stated above, becomes extremely cold when cryogen is flowing therethrough.

End member 28*a*, when received into threads 40 of end portion 34*a*, seals throughhole 38 to form a dead space 38*a*. By providing dead space 38*a* in bushing 34, comparatively little heat transfer takes place between gauge 28 and cryogen which drifts into dead space 38*a* from bypass line 24. This is because cryogen which has moved into the dead space is well outside the cryogen flow path through line 24.

Figure 5:
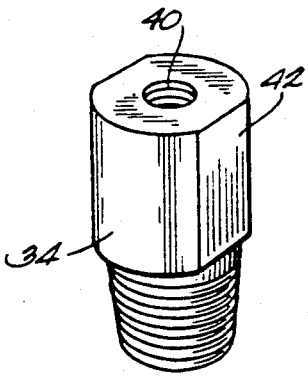
FIG. 5 is a perspective view of the bushing shown in FIG. 4 without a portion broken away.

FIG. 5 shows bushing 44 provided with wrench flats 42 for use in securing bushing 34 to plumber's cross 30.

While a preferred embodiment of the invention has been shown and described herein, it will be understood that such embodiment is provided by way of example only. Numerous variations, changes and substitutions will occur to those skilled in the art without departing from the spirit of the invention. Accordingly, it is intended that the appended claims cover all such variations as are followed in the spirit and scope of the invention.

What is claimed is:

1. A system for controllably venting cryogen of extremely low temperature from a cryostat comprising:

a metallic conduit means for providing a path of flow for the cryogen from the cryostat to an exhaust system;

a gauge for indicating pressure of the cryogen in the conduit means; and fitting means for coupling the gauge to the conduit means;

said fitting means comprising a material of high thermal impedance and having a first end joined to the gauge, a second end joined to the conduit means, and an intermediate portion between the first and second ends for spatially separating the gauge and the metallic conduit means, and for providing a dead space between the gauge and the cryogen path of flow to substantially reduce direct transfer of heat between the gauge and cryogen in the conduit means.

2. The venting system of claim 1 wherein:

the conduit means provides a turn through an angle on the order of 90° in the cryogen path of flow; and the fitting means couples the gauge to the conduit means proximate to said turn in the cryogen path of flow.

3. The venting system of claim 2 wherein:

the conduit means comprises a bypass vent line coupled to the main vent line of the cryostat, the main vent line being sealed by a burst disk which is ruptureable when the pressure in the main vent line reaches a specified level; and the bypass vent line is further coupled to route cryogen flowing through the main vent line around the burst disk at a pressure which is less than the bursting level of the disk.

4. The venting system of claim 2 wherein:

the fitting means comprises a bushing formed of GC-10 material.

5. The venting system of claim 4 wherein:

a valve is placed in the bypass vent line to selectively open and close said line.

6. The venting system of claim 5 wherein:

the temperature of the cryogen flowing through the conduit means is less than on the order of 20° Kelvin.

7. The venting system of claim 6 wherein:

the cryogen comprises helium in a gaseous state.

* * * * *